US006329921B1

(12) United States Patent
Tindall et al.

(10) Patent No.: US 6,329,921 B1
(45) Date of Patent: Dec. 11, 2001

(54) FLAME DETECTOR UNITS AND FLAME MANAGEMENT SYSTEMS

(75) Inventors: David Tindall, Reading; David Innes, Shepperton, both of (GB)

(73) Assignee: Spectus Flame Management Limited, Berkshire (GB)

( * ) Notice: Subject to any disclaimer, the term of this patent is extended or adjusted under 35 U.S.C. 154(b) by 0 days.

(21) Appl. No.: 09/565,318

(22) Filed: May 5, 2000

(30) Foreign Application Priority Data

May 7, 1999 (GB) ..... 9910708

(51) Int. Cl.[7] ..... G08B 17/12

(52) U.S. Cl. ..... 340/577; 340/578; 250/339; 250/554

(58) Field of Search ..... 340/577, 578; 250/554, 339; 356/437

(56) References Cited

U.S. PATENT DOCUMENTS

| | | | | |
|---|---|---|---|---|
| 2,840,146 | | 6/1958 | Ray | 158/28 |
| 3,665,440 | | 5/1972 | McMenamin | 340/228.2 |
| 4,039,844 | | 8/1977 | MacDonald | 250/554 |
| 4,455,487 | * | 6/1984 | Wendt | 250/339 |
| 4,591,725 | * | 5/1986 | Bryant | 250/554 |
| 4,709,155 | | 11/1987 | Yamaguchi et al. | 250/554 |
| 4,882,573 | | 11/1989 | Leonard et al. | 340/578 |
| 4,904,986 | * | 2/1990 | Pinckaers | 340/578 |
| 5,126,721 | | 6/1992 | Butcher et al. | 340/578 |
| 5,245,196 | * | 9/1993 | Cabalfin | 250/554 |
| 5,488,355 | * | 1/1996 | Tindall et al. | 340/578 |
| 5,625,342 | * | 4/1997 | Hall et al. | 340/578 |
| 5,748,090 | * | 5/1998 | Borg et al. | 340/578 |
| 6,061,141 | * | 5/2000 | Goldenberg et al. | 356/437 |

FOREIGN PATENT DOCUMENTS

| | | |
|---|---|---|
| 0 046 587 | 3/1982 | (EP) . |
| 977001 | 12/1964 | (GB) . |
| 2188416A | 9/1987 | (GB) . |
| 2283094 | 4/1995 | (GB) . |

* cited by examiner

*Primary Examiner*—Daniel J. Wu
*Assistant Examiner*—Phung T Nguyen
(74) *Attorney, Agent, or Firm*—Kilyk & Bowersox, PLLC

(57) ABSTRACT

A flame management system comprises two flame detector units which are arranged to view different regions of at least one flame and are connected to separate channels of a processor. Each detector unit has at least two operating modes, such as an infra-red and an ultra-violet operating mode, or a normal and a sensitive infra-red or ultra-violet mode, etc. and is switchable between those modes by the processor. The processor thus selectively processes the output of the two units and actively controls the operating mode of each to obtain responses appropriate to the type and/or condition of the or each flame being monitored. In order to enable both IR and UV monitoring from a single detector unit, the detector includes at least one photo-sensitive member together with an optical element such as an IR filter which operates selectively to deliver an undivided IR or an undivided UV compact to the at least one photo-sensitive member.

19 Claims, 9 Drawing Sheets

FLAME DETECTOR UNITS AND FLAME MANAGEMENT SYSTEMS

BACKGROUND OF THE INVENTION

The present invention relates to flame detector units and flame management systems.

Flame detector units are used to detect the presence of a flame. There are two methods of detecting the presence of flames which are in common use. The first detects light emitted from the flame in the visible and infra red wavelength bands, and this type of flame detector is known as an Infra Red or IR flame detector. The other method is to detect ultra violet light which is also emitted by flames, and a detector which utilises this technique is known as a UV flame detector.

The advantage of detecting ultra violet emissions is that it provides a direct measure of brightness in a flame and in a prescribed range of wavelengths gives excellent discrimination. It is well suited to the task of monitoring oil or gas flames, which burn brightly and generate a significant signal in the prescribed wavelengths.

Utilising the infra red detection technique, on the other hand, has the advantage that it is not as strongly susceptible to attenuation by oil mist and combustion products, or water vapour. It is also more tolerant of movement than is the UV spectral base. Thus, IR is particularly suited to the task of monitoring pulverised coal (pc) flames, which do not burn brightly within a well defined envelope but tend to coalesce in a random fashion resulting in movement, and which also generate water vapour.

Not only is the IR spectral response well suited for monitoring pulverised coal flames but it is also particularly useful for looking at the origin of oil flames right inside the oil spray or monitoring steam atomised burners.

Every flame also has a characteristic flicker associated with it, the flicker frequency of which corresponds to intensity fluctuations and these fluctuations are generated by combustion in turbulent gaseous eddies as they are convected in the flame envelope. Put another way flicker frequency refers to the dynamic frequency of "flicker" associated with the visible and Infra Red wavelength bands, and the effectiveness of UV and IR detection has been found to be improved by utilising flicker frequency filtering in conjunction therewith, a technique known as UV flicker (UVF) and IR flicker (IRF) flame detection respectively. These modified techniques provide better discrimination than is possible using solely UV or IR techniques.

Flicker frequency is selectable in the range 10 to 1200 Hz for UV or IR. The preferred dynamic frequency for discriminatory flame detection is probably in the higher end of the range 100–1000 Hertz. There is also a fundamental flicker, typically around 25 Hz, which affects IRF or UVF response because of air currents and macro turbulence. For this reason higher frequency Flicker settings will provide better discrimination as opposed, for example, to detectors that refer to fundamental flicker which yields the biggest signal. The choice of optimum dynamic frequency within the preferred range, for the purpose of discriminatory flame detection, is dependent largely on boiler conditions, but it is also influenced by fuel type, burner geometry and mixing factors.

To apply UV or IR Flicker it is fist necessary to characterize the optimum dynamic frequency for the boiler/burner situation, and then to set the processor to accept Flicker frequencies within a narrow band on either side of the optimized value. This adjustment involves two parameters, one, the flicker frequency adjustment, the other, the quality factor (Q) or bandwidth adjustment. The quality factor is normally factory set, and the flicker frequency adjusted on-site by an installation technician.

Both IR and UV detectors, whether utilising the flicker frequency filtering enhanced detection technique or the non-filtering detection technique, can, as indicated above, only detect the presence or absence of the flame—no qualitative information regarding the condition of a flame can be obtained. This problem was addressed in GB 2283094, which discloses an oil flame monitoring system which utilises two detectors to monitor a single flame—an IR detector monitoring a first region of the flame and a UV detector monitoring a second region of the same flame. The different characteristics of the two detection systems enable the results obtained from the two detectors to be used to provide information not only about the presence or absence of the flame but also the condition of that flame.

However, this system has been found to be rather inflexible and rather bulky since it requires two flame detectors units, each producing a dedicated UV or IR response, and a processing means associated with each unit to process the output signal. Also, since the flicker frequency adjustment is preset, the system is useful for only a limited range of emission from a flame.

SUMMARY OF INVENTION

According to one aspect of the present invention, there is provided a flame management system comprising at least one flame detector unit arranged to monitor at least one flame in at least two response modes, and a processor which selectively processes the output of the or each detector unit for responses appropriate to the type and/or condition of the at least one flame. In one embodiment, the system comprises two flame detector units each of which is operable in a single mode, the processor selectively processing their output signals for a response appropriate to the condition and/or type of flame present. One flame detector unit may, then, provide an IR or IRF response and the other a UV or UVF response, or both may provide a dedicated IR, IRF, UV or UVF response but with different sensitivity settings.

In another embodiment, the system comprises a single flame detector unit which has at least two different modes of operation which can be selected by the processor. In particular, the invention may comprise at least one flame detector unit, the or each unit being operable in at least two different modes to monitor at least one flame, and a processor which processes the signals from the or each unit and actively varies the operating mode of the or each unit in response to changes in the condition of the or each flame. The different modes might be a UV or UVF response mode and an IR or IRF response mode, or might be a normal and sensitive setting for a dedicated IR or UV detector or a combination of the two.

The processor can preferably effect adjustment of the flicker frequency and also vary the signal gain for the or each detector, that is adjust the amplification applied to the response signal obtained from each detector unit. Each signal is preferably amplified to lie typically in the range of 0 to 10 volts dc and is interpreted as a percentage of the nominal maximum. By enabling active control of this setting, the sensitivity of the or each detector is improved. Alternatively or in addition, the system preferably includes at least one detector unit which is operable as either an IR or a UV responsive unit to suit the particular conditions and/or type of the flame, said operational mode being controlled by the processor. The processor may also implement flame support systems and set up alarms or the like in response to transient or deteriorating combustion conditions rather than merely shutting off a burner.

The present invention requires just a single management processor for a plurality of detector units which function in parallel, each detector being connected to a different channel of the processor, and these detector units may be dedicated to one flame, analysing different regions thereof, or may be arranged to monitor separate flames produced by different burners, either at different locations or at the same location at different times. In the case of monitoring two or more different flames produced by different burners, should any burner go to flame fail, the operational burners can automatically be kept in service provided their flame condition remains acceptable.

The system has been found to be particularly effective when implemented using a two channel processor, i.e. utilising dual channel technology, but processors with three or more channels may also be used.

Preferably, each channel of the processor is provided with two pairs of settings of flicker frequency and signal gain, the first pair of settings being referred to as the "Status" settings and the second pair as the "Alternative" settings. It is, however, also possible to provide a processor which includes more than two pairs of settings on each channel. For at least one of the channels, the two pairs of settings of flicker frequency and signal gain may be configured so that a single detector unit is operable to provide, selectively, both IRF and UVF response, the status setting of the flicker frequency and signal being used, for example, when IRF response is required and the alternative settings when the detector is to be operated as a UVF unit. Alternatively, each channel may be configured for a dedicated IRF or UVF unit, the status and alternative setting being chosen to suit analysis of different flame conditions, for example the status settings might be suitable for monitoring a normal flame and the alternative for providing better response and sensitivity when monitoring a failing flame.

Providing alternative flicker settings in this way enables each flame detector unit to better recognise changes occurring in flames. By altering the gain, the UV or IR signal response or voltage can be effectively increased when signal response is expected to weaken.

Thus, it is possible to selectively make an adjustment to either or both flicker frequency or signal gain, for example, to make the flame management system more tolerant of a transient condition, which might otherwise shut down a safe burner. Alternatively, by switching between the IRF and UVF responses as well as changing flicker frequency and signal gain settings, effective monitoring by a single detector of different flames present at different times can be achieved.

Generally, one pair of settings for gain and flicker frequency will be programmed for appropriate "normal" operating conditions for the application, usually being chosen so that the detector will be highly discriminatory and less tolerant. These are the "Status" settings. The "Alternative" settings will generally apply to different burners or transient or changing combustion conditions. For example, in the start up process for a land power generation boiler a more tolerant gain setting may be used as an alternative setting for the cold start and no load conditions, with status settings being used once the turbine is synchronised and generating significant load.

In another example alternative settings can be arranged to view two flames with a single detector, but only if the two flames to be monitored occur in the same place at different times. Thus, a single flame detector unit can be set up with alternative flicker frequency and signal gain settings to monitor an oil flame through the start up process mentioned above, and subsequently, by switching over to the status settings of flicker frequency and gain, it can be used to monitor a coal flame instead of the oil flame.

Clearly, the present invention provides a system which is very versatile in that it may easily be adapted for wide variety of applications by appropriate choice of processor logic.

In addition to providing different settings for flicker frequency and signal gain, the system may in addition or alternatively selectively use a single detector unit for IR or UV detection. This is made possible by utilising the flame management system of the invention with a flame detector unit according to another aspect of the invention, which combines both IR and UV spectral responses into a single detector unit and is selectively operable to provide either an IR or a UV response output to a flame management processor. In particular, the detector comprises at least one photosensitive member upon which is incident at least one of the undivided IR component and the undivided UV component of the light emitted by a monitored flame towards the detector. In this way, the sensitivity of the detector is maintained since the entire IR and/or UV component entering the detector reaches the photo-sensitive member responsive thereto, i.e., the intensity of that component is not diminished, for example by passing through a beam splitter.

One preferred embodiment comprises a photocell and a filter element disposed between the photocell and a viewed flame, the filter element being movable between a first position in which it intersects the optical ray path, whereupon the photocell is responsive to one of UV and IR radiation, and a second position in which the filter is retracted from the optical ray path, whereupon the photocell is responsive to the other of UV and IR radiation. A UV pass filter which filters out the IR components so as to enable the unit to operate as a UV detector when intersecting the ray path is particularly effective.

An alternative embodiment comprises a first photocell, a second photocell and an optical element, such as a reflecting mirror, disposed in the optical path between the first photocell and a flame to be viewed, the optical element reflecting, preferably deflecting, one of the IR and UV components of the flame towards the second photocell and transmitting the other of said IR and UV component to the first photocell.

Preferably, the optical element is a dichroic mirror which allows light having wavelengths typically larger than 500 nm, which includes green through infra red light, to pass through it, whereas shorter wavelengths, which includes ultra violet light, are reflected by the dichroic mirror. The dichroic mirror is preferably positioned to deflect the mirrored light onto the UV photocell whereas the IR light passes through undeflected. A processor connected to the two photocells then selects the output signal from one or the other photocell depending on whether IR or UV response is required.

BRIEF DESCRIPTION OF THE DRAWINGS

In order that the invention may be well understood, there will now be described some embodiments thereof, given by way of example, reference being made to the accompanying drawings, in which.

DETAILED DESCRIPTION OF THE PRESENT INVENTION

Figure 1:
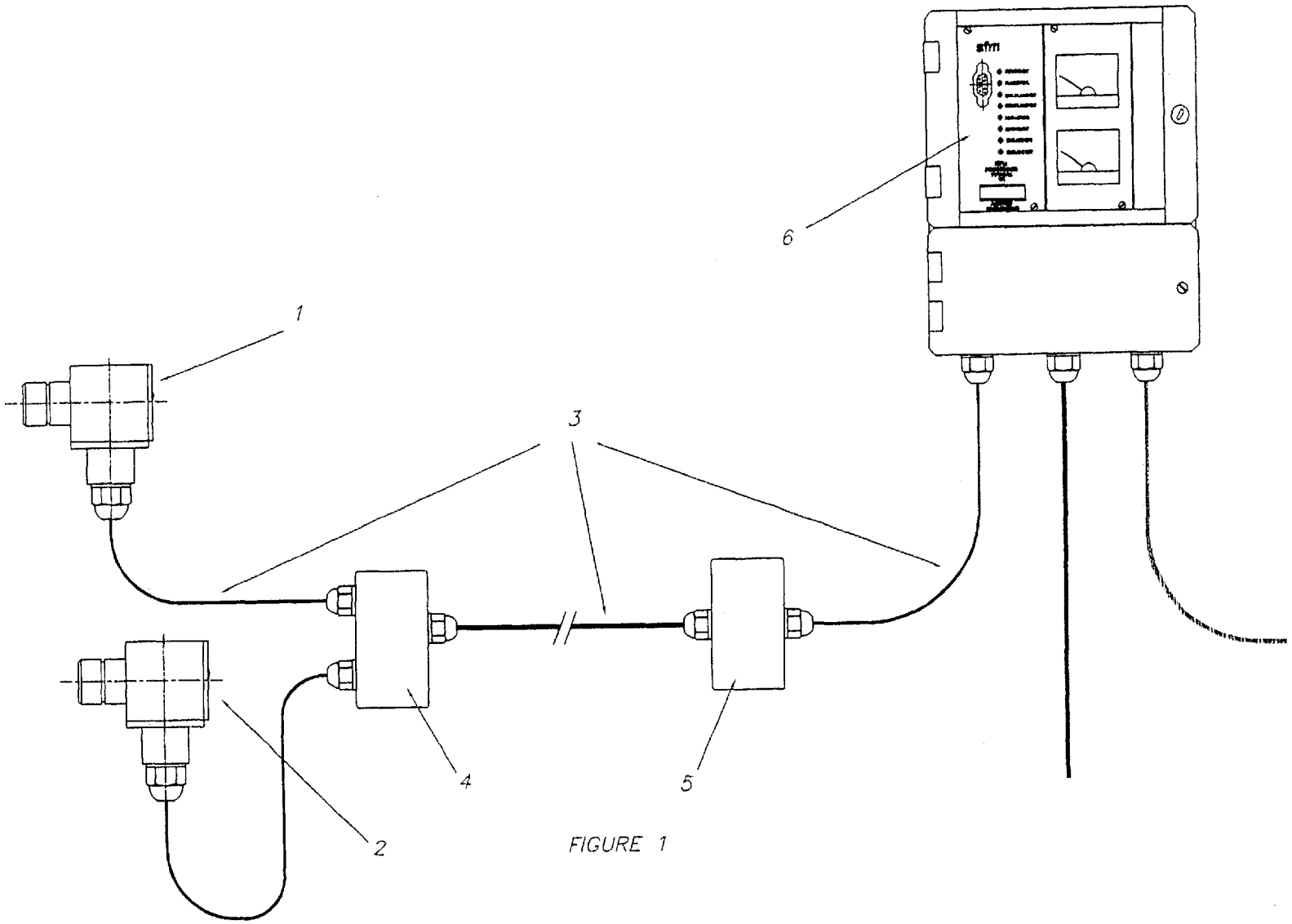
FIG. 1 is a schematic illustration of a flame management system according to the invention having two flame detector units connected to a single flame management Processor.

Referring first to FIG. 1, there is shown a schematic illustration of the parts of a flame management system of the invention, which includes a first flame detector unit 1 and a second detector unit 2 connected by appropriate cabling 3, such as electromagnetically screened cable, through junction boxes 4, 5 to a dual channel flame management processor 6.

2*a* and 2*b* show a first exemplary embodiment of the system of the invention suitable for analysing two flames produced at different times in the same burner. The two detector heads 1, 2 are arranged to monitor different regions of two flames 10, 12 produced in a burner at different times, namely a gas flame 10 and an oil flame 12. The first detector unit 1 is positioned in close alignment with the center axis 14 of the burner for viewing both the gas flame 10 and the oil flame 12 when operated in sequence, and the second flame detector unit 2 is positioned to view only the oil flame 12. The two detector units 1, 2 are connected to two channels of a management processor (not shown) which is programmed with status and alternative settings of flicker frequency and signal gain for each detector unit 1, 2.

In operation, the oil burner 15 is started by activating a gas igniter to produce a gas flame 10, whose presence must be confirmed before fuel oil can be admitted to the burner. Such confirmation is obtained from the first flame detector unit 1 operating in its first mode as a UVF detector with its flicker frequency and signal gain set to the "status" settings.

Once the presence of the gas flame is so confirmed, the fuel oil valve 16 is opened to admit fuel oil, and the second flame detector unit 2 is utilised to confirm the presence of an oil flame by viewing the primary combustion region 17 of the fuel oil flame 12 for UVF response, again with its status settings of flicker frequency and signal gain. In certain preset circumstances the second flame detector unit 2 may be utilised with more tolerant "alternative" settings of flicker frequency and signal gain.

Once the presence of the oil flame is confirmed by the second detector 2, the gas flame 10 is extinguished and the first detector 1 is switched to IRF response with its flicker frequency and signal gain being set to the alternative settings, for monitoring the origin of the oil flame. The fist detector I can thereby confirm the continued presence of the flame. Both flame detector units 1, 2 can then be used to continue to monitor different regions of the oil flame, one using IRF and one using UVF, from which both the presence of the oil flame and qualitative information about its condition can be ascertained in a known manner.

By utilising a single two channel programmable processor which has both input and output lines, the entire initialisation sequence described above as well as the steady state of 10 operation of the burner can be monitored and controlled automatically, the processor performing a number of flame management functions in response to changing conditions.

The processor can be programmed to carry out transient ignition support, spectral response switch-over and alternative flicker frequency and signal gain setting selection as exemplified above as well as controlling the fuel feed to the burners, activation of visible or audible alarms, or displaying high level language messages.

In a simplified version of the above embodiment, the system may also be programmed with just a single flicker frequency and signal gain setting for each detector unit so as merely to monitor the established oil flame and provide qualitative information about the condition thereof in a known manner.

Figure 2A:
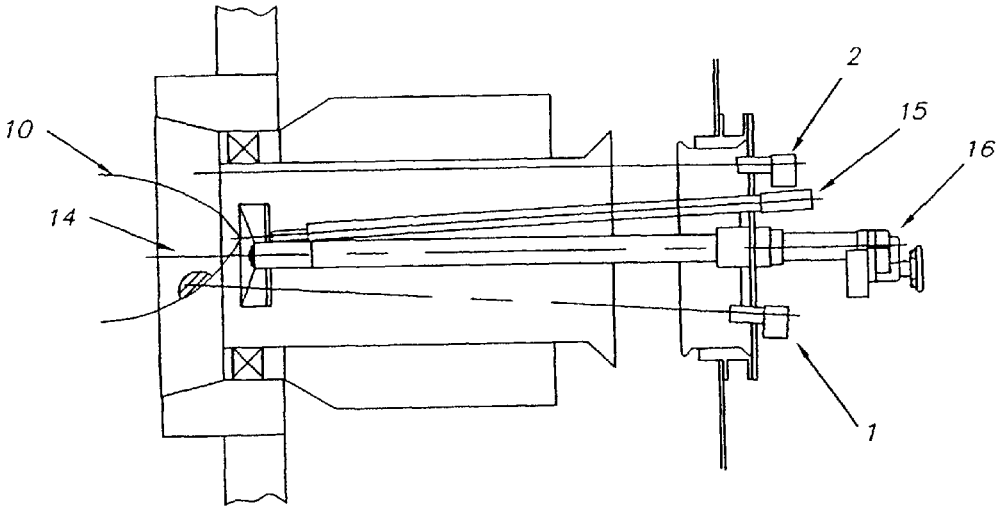
FIGS. 2*a* and 2*b* show an illustration of a first embodiment of the invention in which two detector units may be used to monitor two different flames produced sequentially by a single burner.
Figure 2B:
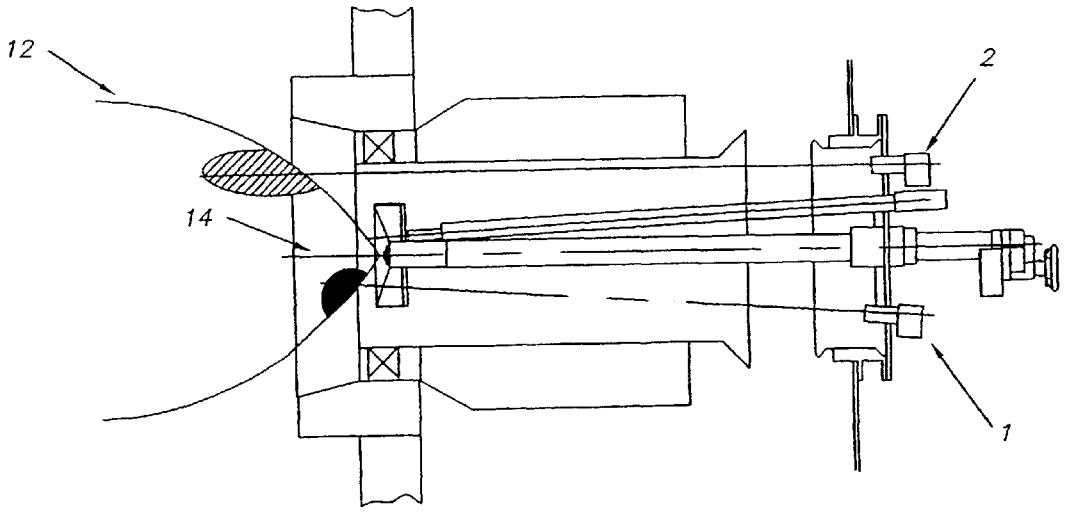
Figure 3A:
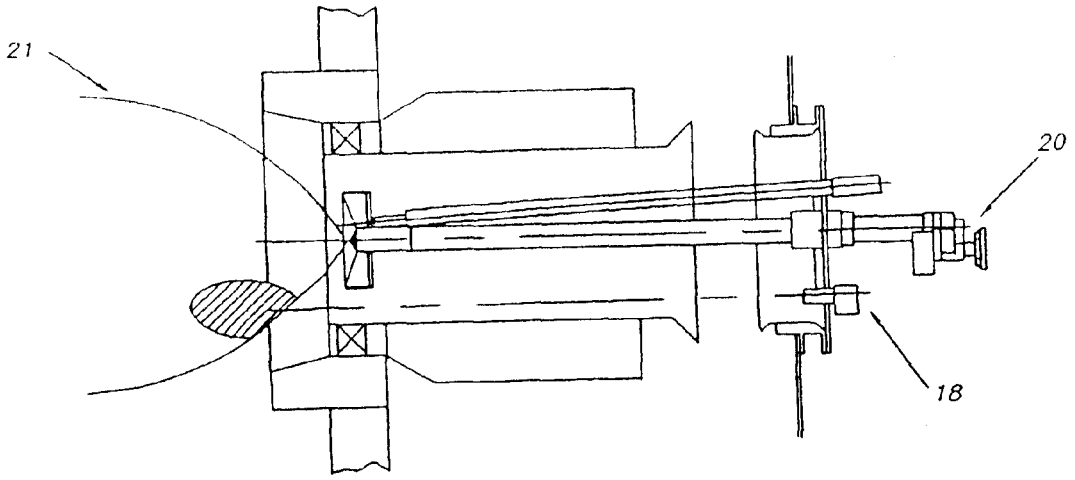
FIGS. 3*a* and 3*b* show a second embodiment in which two detector units monitor two different flame produced simultaneously by different burners.
Figure 3B:
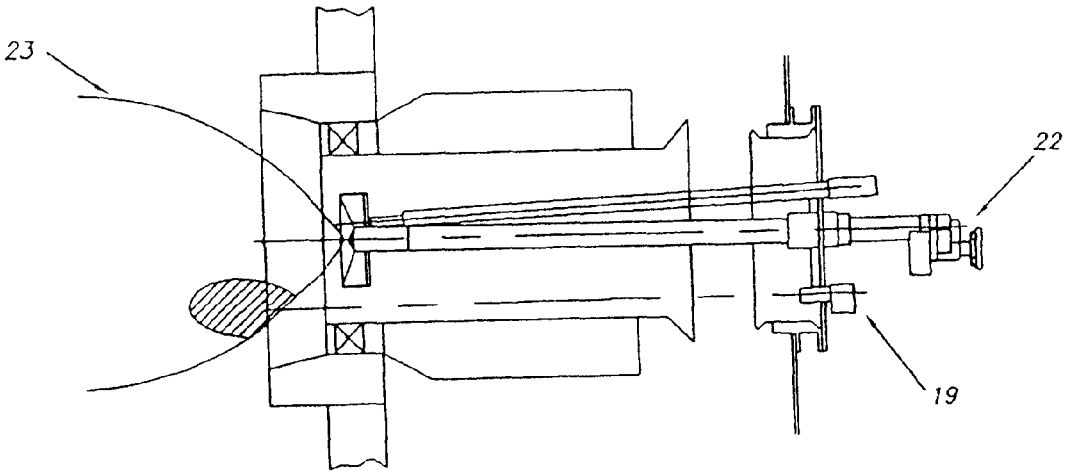

Instead of two detector units being used to monitor flames produced in a single burner as illustrated in FIGS. 2*a* and 2*b*, the flame management system of the invention can alternatively be used to monitor two oil burners contemporaneously as shown in FIGS. 3*a* and 3*b*. FIG. 3*a* shows the first of two such burners with an injector 20 feeding a first flame 21 which is viewed by a first flame detector unit 18. The second burner is similarly formed with an injector 22 featuring a second flame 23 which is viewed by a second flame detector unit 19. Both flame detector units 18, 19 include the facility for being switched between IRF and UVF response by the processor which is preferably programmed to use the status flicker frequency and signal gain settings for UVF monitoring of each unit 18, 19 and the alternative settings when IRF response is required. Typically, UVF monitoring will be used when a stable flame is present, switching to IRF when transient or other preset operating conditions arise.

The processor in this embodiment may be programmed with the same status and alternative settings for each detector unit 18, 19, or may have different settings for each one. The flame management system applied to this embodiment enables two different flames to be actively managed simultaneously and independently, so that one burner can be shut down in the case of improper operation such as a flame fail situation arising or monitored using more appropriate detection method or flicker frequency and signal gain setting without effecting the monitoring or operation of the other burner.

Figure 4:
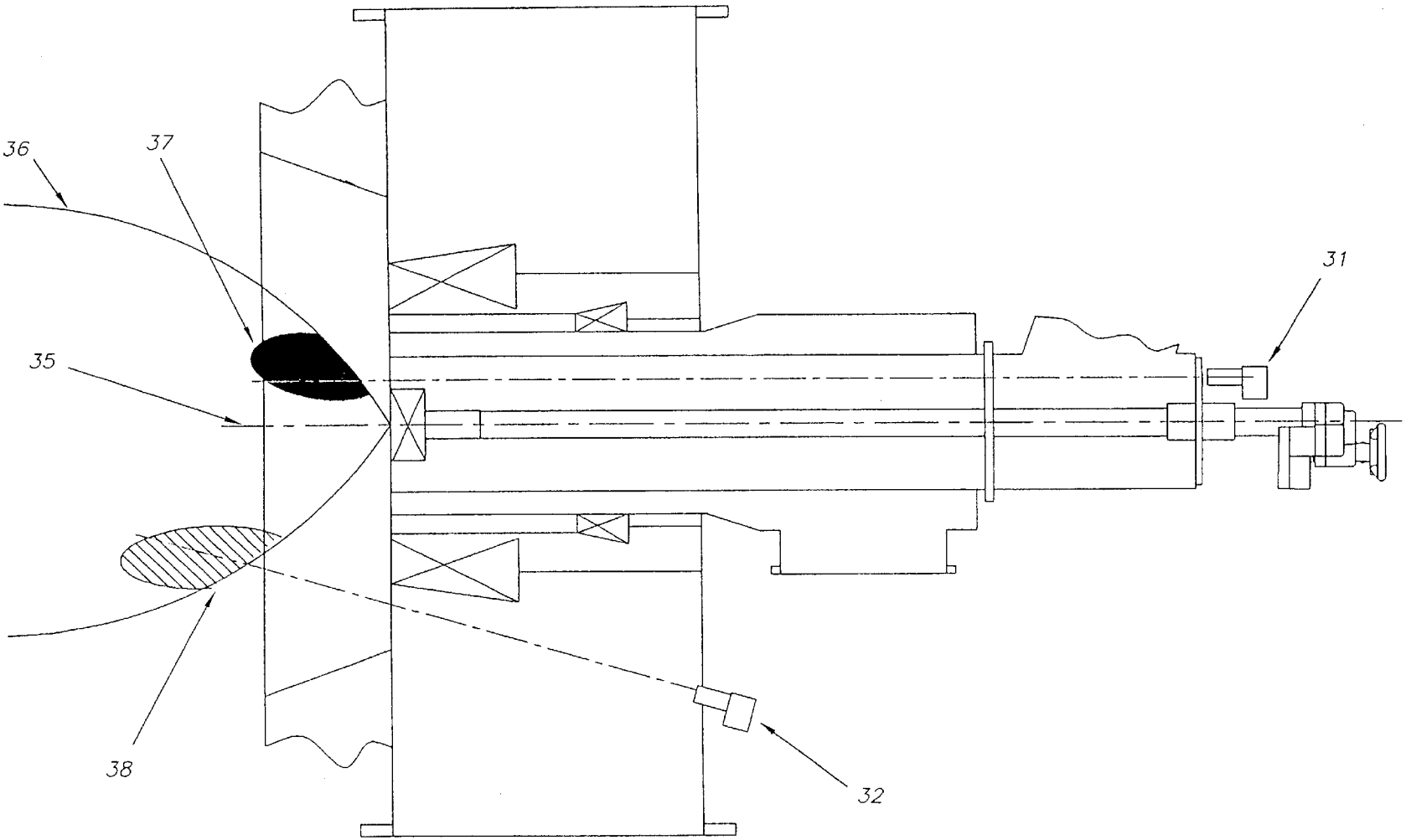
FIG. 4 is a third embodiment of the invention which utilises a lighting-up oil burner in combination with a pulverised coal burner, shown with only the lighting-up oil burner in operation.
Figure 5:
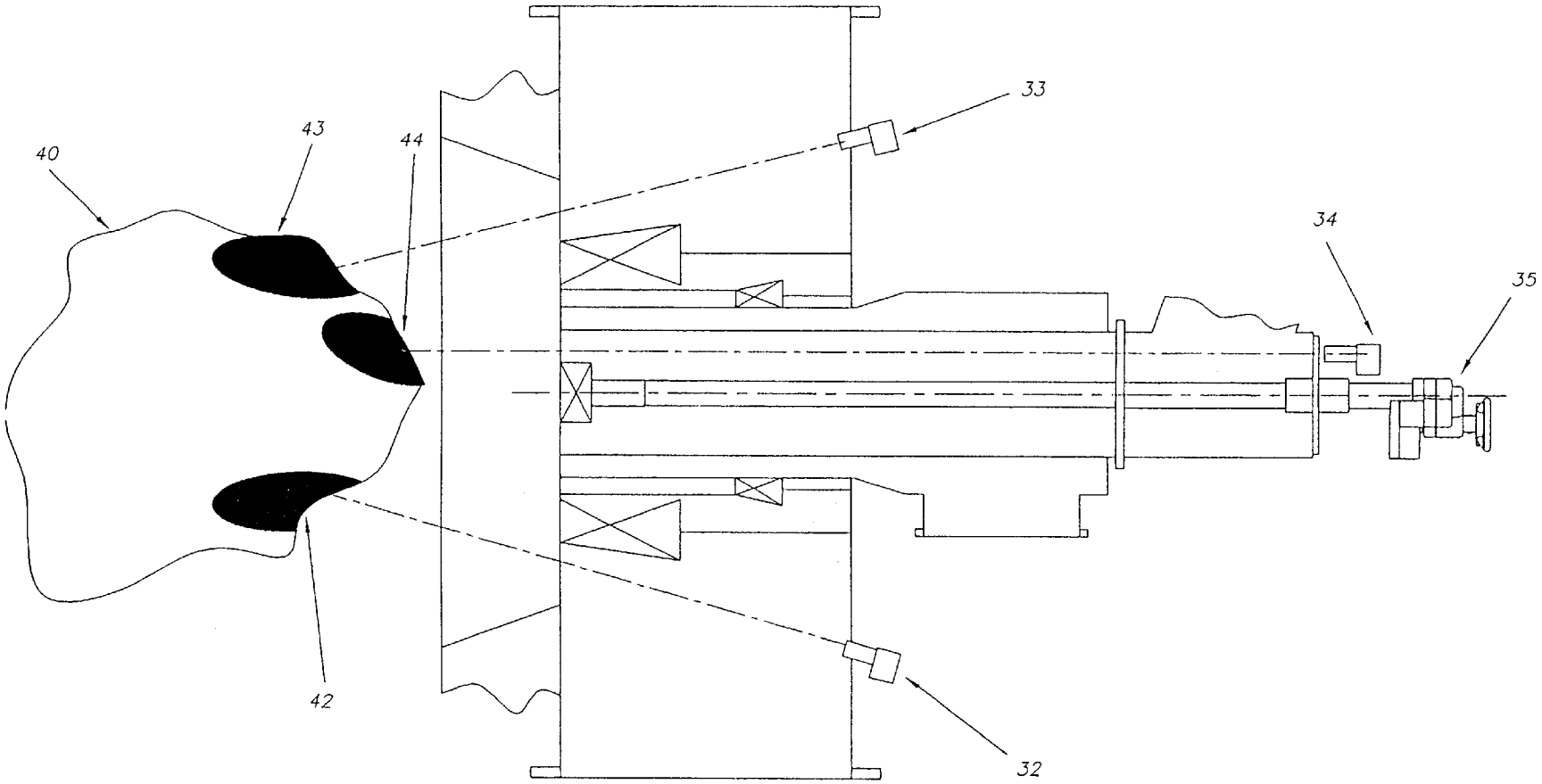
FIG. 5 is the arrangement of FIG. 4 with only the pulverised coal burner in operation.

FIGS. 4 and 5 show a further embodiment of the invention used in a lighting up oil burner positioned coaxially along the center line of a pulverized cool burner, an arrangement typically used in coal-fired power stations. This embodiment utilizes a total of four flame detector units. A first unit 31 is positioned just off the center axis 35 of the burner and views the origin 37 of the oil flame 36 and a second detector unit 32 selectively views the primary combustion region 38 of the oil flame 36 and the primary combustion region 42 of the coal flame 40. Third and fourth detector units 33, 34 are also provided, the third 33 arranged offset to view the primary combustion region 43 of pulverized coal flame 40 downstream of its origin, and the fourth 34 positioned in close proximity to the center line 35 of the coal burner to view the origin 44 of the coal flame 40.

Preferably, in this embodiment the system is realised by using two flame management processors each having two channels so that a total of four channels are available, one for each detector unit. However, it is also possible for a single four channel processor to be used.

The first 31 and third 33 detector units are each used for IRF monitoring only and each is operable with its flicker frequency and signal gain settings set to either its status or alternative settings. The second detector unit 32 is selectively operable as either an IR or a UV detector and is similarly provided with two settings of flicker frequency and signal gain, the first setting dedicated to IR operation and the second to UV operation. The fourth detector unit 34 is programmed for IR operation only, and, as with the first and third detector units An operate as an IR detector with either status or alternative flicker frequency and signal gain settings, depending on the condition of the flame.

Although arranged coaxially, the lighting up oil burner and pulverised coal burner illustrated in FIGS. 4 and 5 operate independently of each other. In normal operation the oil burner is ignited first and may burn for some hours before the pulverised coal burner is started.

The coal burner is in turn ignited by the oil burner when the pulverised coal is introduced to the coal burner register. Once the coal burner has stabilised, which might also take several hours, the lighting up oil burner is stopped.

FIG. 4 shows the initial phase of the procedure with the lighting up oil burner only in operation, the first 31 and second 32 flame detector units are used to monitor the oil flame 36 at its origin 37 and in its primary combustion region 38, respectively. While the lighting up oil burner only is firing, the first flame detector unit 31 operates as an IRF detector with status and alternative flicker frequency and signal gain settings available as required. The second flame detector unit 32 is selected to respond to the UVF wavebands and has its flicker frequency and signal gain settings set to status setting only. For both flame detector units, with only the oil burner in service, the optimal presets for their status and alternative settings of flicker frequency and signal gain will have been pre-programmed into the flame management processor.

When the pulverised coal burner is started (i.e. a mill is started) initially both the oil burner and the pulverised coal burner are firing. The first flame detector unit 31 is used to continue monitoring the lighting up oil burner. The second, third and fourth flame detector units 2, 3, 4 are now utilised to monitor the pulverised coal burner. In this mode of operation the first flame detector unit 31 continues to respond to IRF wavebands at its status settings of flicker frequency and signal gain, or the processor may be programmed to switch to the alternative flicker frequency and signal gain settings.

The second flame detector unit 32 is now automatically switched by the processor to respond to IRF wavebands and is operated with its alternative settings of flicker frequency and signal gain. At the same time, the third and fourth flame detector units 33, 34 are selected to respond to IRF wavebands, status or alternative settings of flicker frequency and signal gain being available for each and being selected to suit the operating conditions or the like.

FIG. 5 shows the final phase in which the pulverised coal flame 40 is established and the lighting up oil burner stopped. The first flame detector unit 31 is no longer used and the second flame detector unit 32 continues to respond to IRF wavebands with its alternative settings of flicker frequency and signal gain. The third and fourth flame detector units 33 and 34 continue to monitor the coal flame for IRF response with their flicker frequency and signal gain set to the status setting. The third and fourth Flame Detector units 33, 34 may, alternatively, be programmed to activate more tolerant alternative settings of flicker frequency and signal gain.

Figure 6:
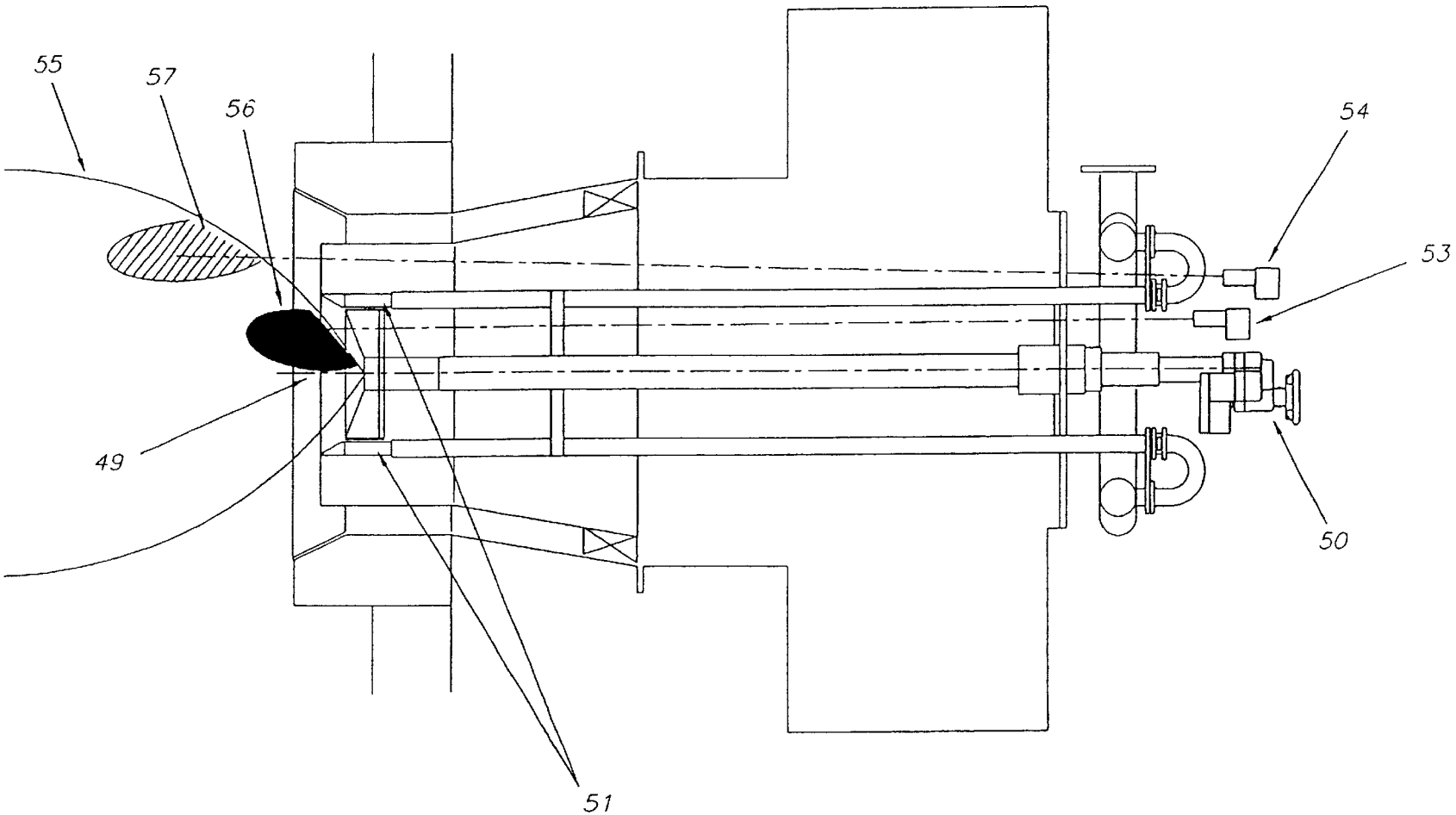
FIG. 6 is a fourth embodiment adapted to monitor a dual fuel burner configured to burn gas or fuel oil with two detectors shown burning fuel oil only.
Figure 7:
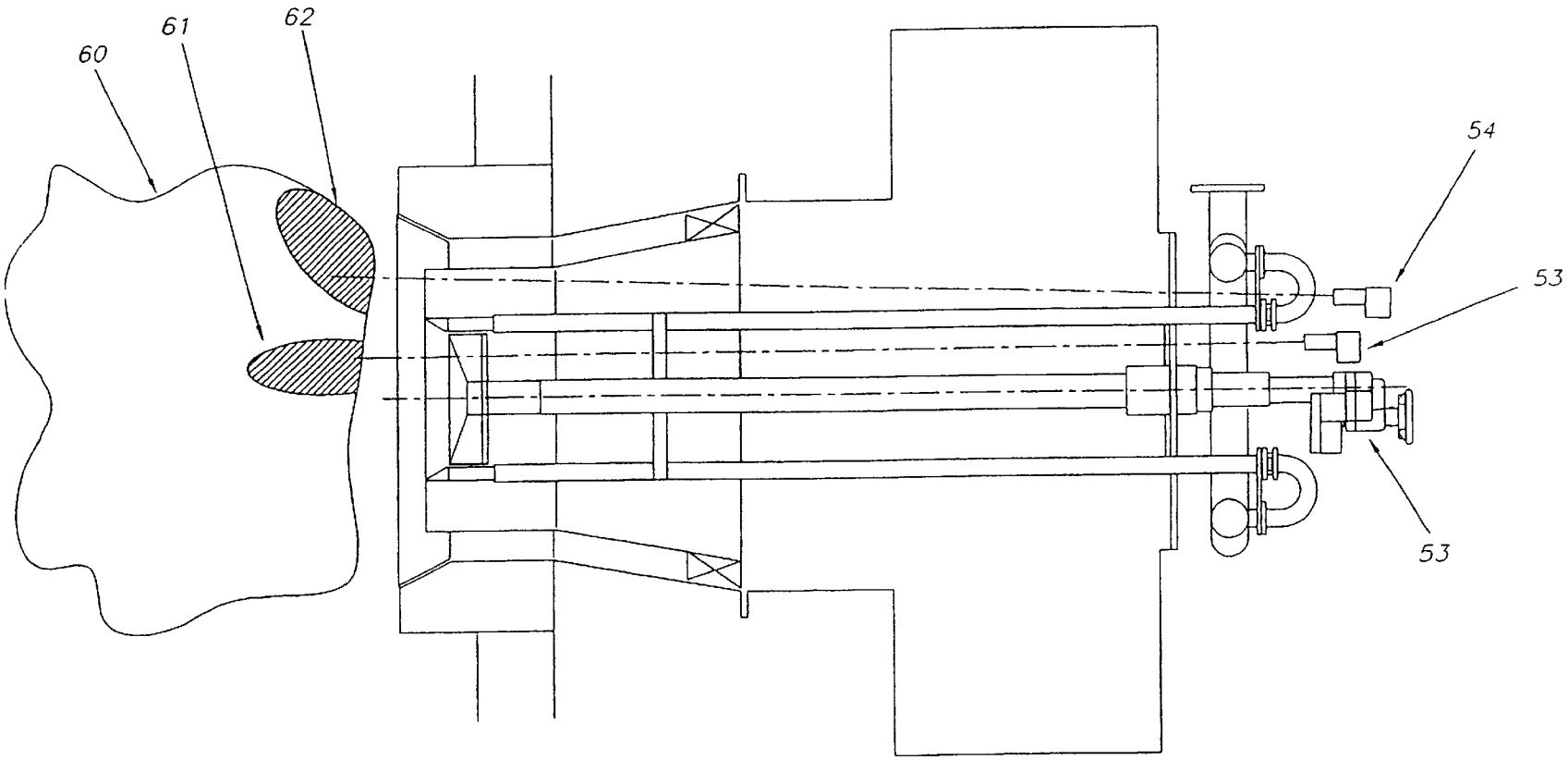
FIG. 7 the embodiment of FIG. 6 shown burning gas only.

FIGS. 6 and 7 show anther embodiment of the present invention suitable for use with a dual fuel burner, which burns fuel oil through a fuel injector 50 disposed in alignment with the center axis 49 of the burner and inset to a furnace. This burner configuration can also burn gas through a plurality of gas nozzles (or spuds) 51 which are concentrically disposed around the center axis 49 and which are also inset to the furnace.

A first detector unit 53 of the flame management system of the invention is disposed just off center of the center axis 49 and views the origin 56 of the oil flame 55 or the origin 61 of the gas flame 60. A second detector unit 54 is arranged selectively to view the primary combustion region 57, 62 of the oil or gas flames 55, 60, respectively.

The two detector units 53, 54 are each connected to one channel of a two channel processor (not shown) of the management system. The processor uses the first detector 53 selectively to monitor the oil flame 55 for IRF response with the flicker frequency and signal gain set to the status setting, and to monitor the gas flame 60 for UVF response with the flicker frequency and signal gain on alternative setting. The second detector 54 is configured to monitor only for UVF response for both flames and both its status and alternative settings can be used for monitoring both the oil and the gas flame.

FIG. 6 shows the burner operating with an oil flame 55 only and the management system utilising the first unit 53 to monitor the origin 56 of the oil flame 55 for IRF response with its flicker frequency and signal gain adjustments set to status setting, and the second flame detector unit 54 to monitor the primary combustion region 57 for UVF response adjusted to whichever of the status and alternative settings is appropriate for the conditions.

When gas is introduced into the burner, there is a transition period during which both the oil flame 55 and the gas flame 60 are present, which situation continues until the gas flame 60 is established, whereupon the oil supply is terminated. During this transition period, the processor continues to monitor using both detector units 53, 54 but selects the first unit 53 to monitor the UVF response of the gas flame and, accordingly switches its flicker frequency and signal gain to the alternative setting.

Once the processor detects that the gas flame 60 is established, it terminates the oil supply and uses both the first and second detector units 53, 54 to monitor the gas flame 60, the second detector unit 54 continuing to view the UVF response with selective activation of its status or alternative settings to suit the operating conditions. This is shown in FIG. 7.

Of course, the system could also operate the burner starting with a gas flame and switching over to an oil flame by simply reversing the above logic.

Figure 8:
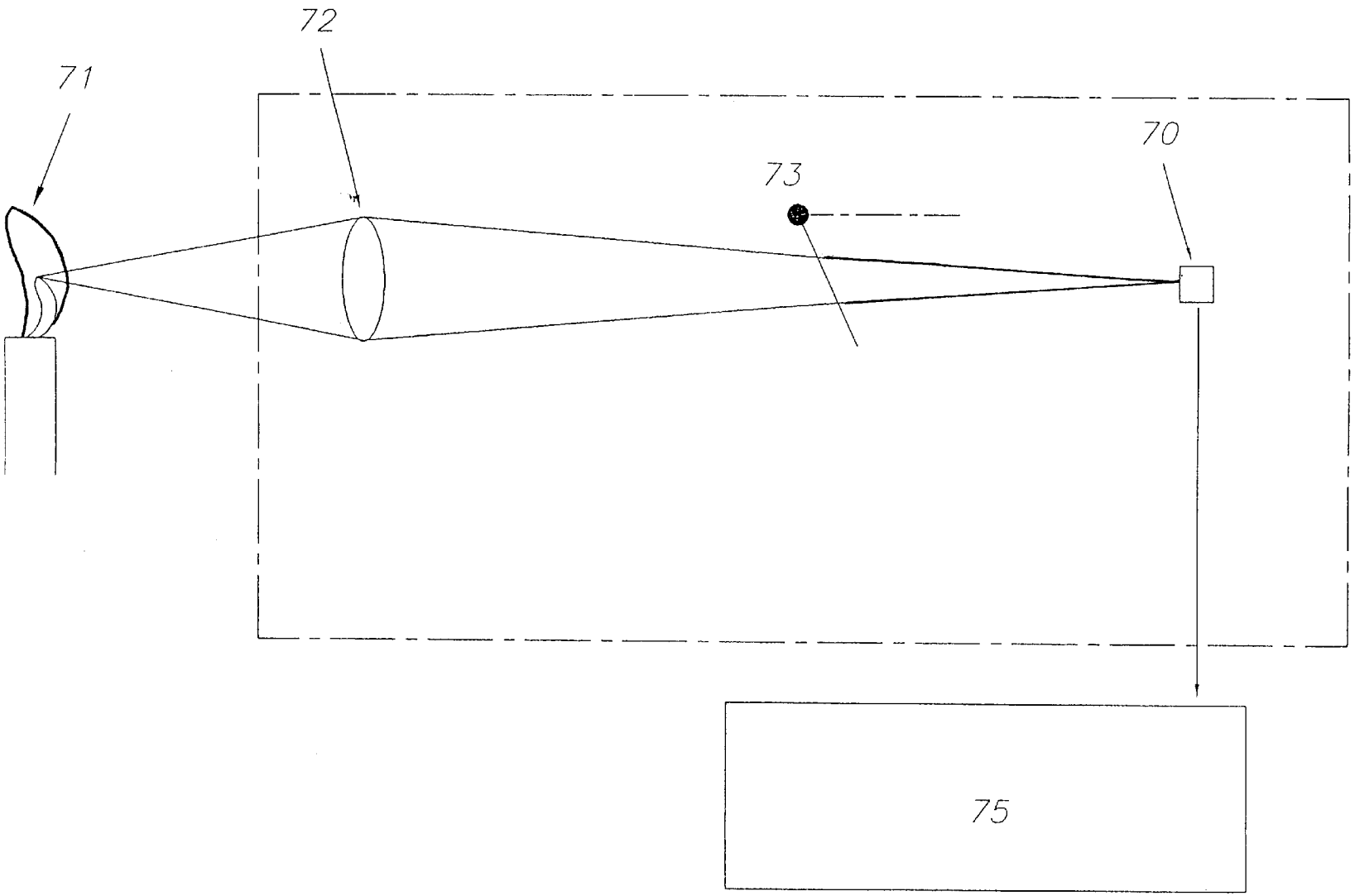
FIG. 8 is a first embodiment of a detector unit selectively operable as both an IR and a UV responsive unit according to another aspect of the invention.

FIG. 8 shows a first embodiment of a flame detector unit which can be selectively used to monitor UV or IR response. The unit comprises a single photocell 70 for monitoring the response of a flame 71 and a lens 72 disposed in the optical path between the flame and the photocell 70 for focusing the light from the flame 71 onto the photocell 70.

Also disposed in the optical path, preferably between the lens 72 and the photocell 70, is a UV pass filter 73 which is movable, for example, pivotable about one end, between a first extended position in which it intersects the optical path between the flame 71 and the photocell 70 and a second retracted position in which it is withdrawn from said optical path (shown in FIG. 8 in phantom). The movement of the filter is preferably achieved by a motor (not shown) controlled by a flame management processor 75 connected to the photocell 70.

If the photocell is required to monitor UV response, the filter is moved to its first position shown in solid in FIG. 8. This filters out the IR light so that only the UV response passes to the photocell. Alternatively, if IR response is required, the filter is moved to its retracted position, out of the optical path, so that both the IR and UV responses pass to the photocell, which detects the IR in preference to the UV component since the former component is the dominant one.

Instead of being mounted for pivotal movement, the filter could be retracted by horizontal or vertical sliding or could be movable in some other manner.

Figure 9:
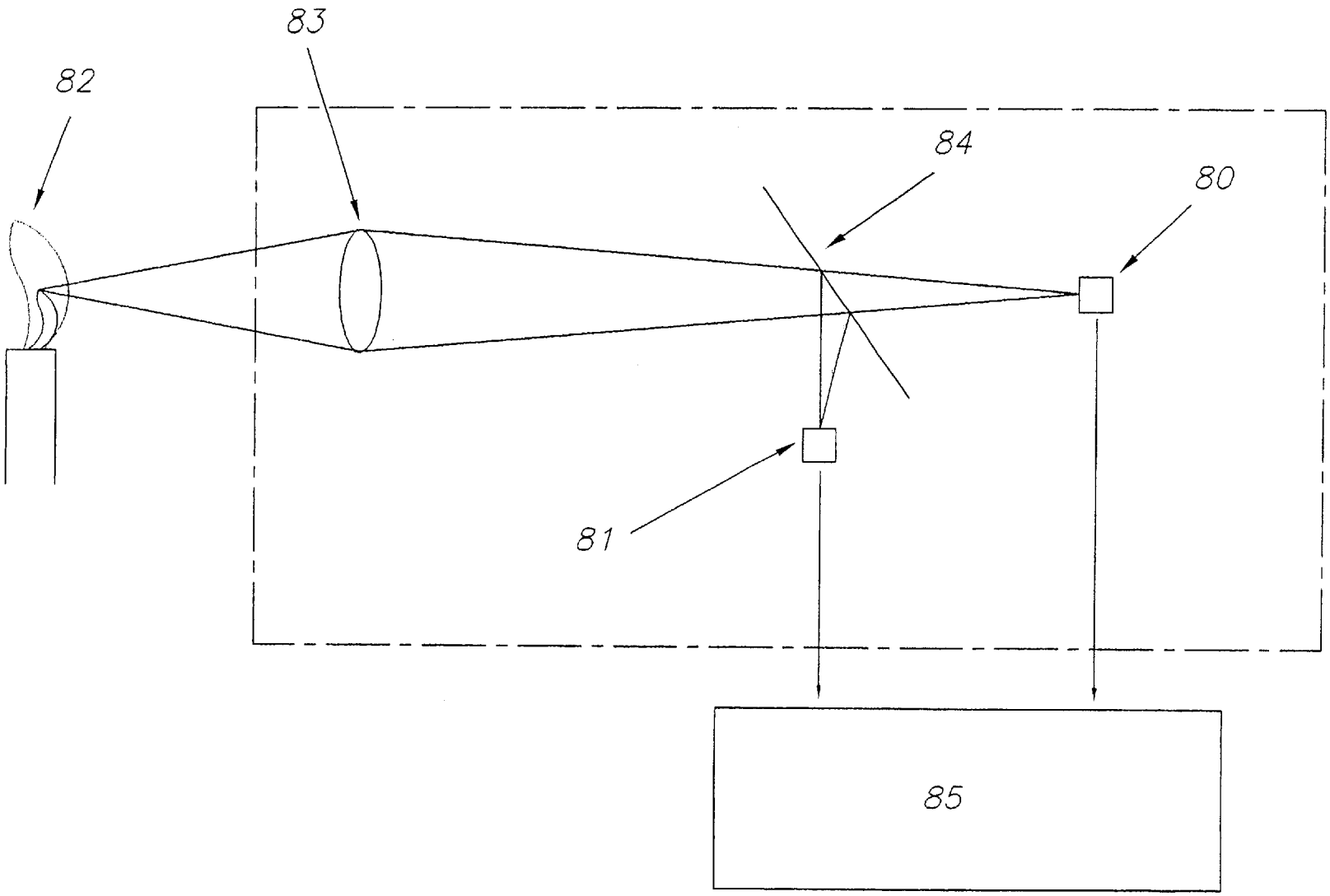
FIG. 9 is a second embodiment of a selectively operable IR/UV detector unit.

FIG. 9 shows a second embodiment of a selectively operable UV and IR response detector unit which includes two photocells, a first 80 dedicated to IR monitoring and the second 81 dedicated to UV monitoring. The IR photocell 80 is arranged in a similar manner to the photocell 70 of the embodiment of FIG. 8 to directly view a flame 82 though a focusing lens 83. Disposed in the optical path between the IR photocell 80 and the flame, preferably between the lens 83 and the photocell 80, is a mirror 84 which transmits and reflects different components of the light emitted by the flame 82. A dichroic mirror which typically allows light having wavelengths longer than 500 nanometers, which includes green through infra red light, to pass through it, but which reflects light having shorter wavelengths, which includes ultra violet light, is particularly effective for this purpose.

The mirror is positioned and oriented in the optical path such that the mirrored light is deflected onto the UV photocell whereas the transmitted light falls onto the IR photocell. Both photocells 80, 81 are connected to the same flame management processor 85 which monitors the output of one or other photocell 80, 81 depending on whether IR or UV response is currently required.

It will, of course, be understood that the mirror may alternatively be produced of material which transmits the UV and reflects the IR component, in which case the positions of the IR and UV photocells in FIG. 9 would be reversed.

In a third embodiment not illustrated, the mirror 84 could be replaced by a refractive or diffractive material, such as a diffractive grating, which refracts or diffracts the different components of the light emitted by the flame depending on their wavelengths. The IR photocell and UV photocell can then be appropriately positioned to receive the IR and UV components of the refracted light respectively, and, as with the previous embodiment, the processor selectively takes its input from one or the other photocell depending on whether IR or UV monitoring is required.

What is claimed is:

1. A flame management system comprising at least one flame detector unit arranged to monitor at least one flame, the at least one flame detector unit comprising a single photocell having at least two predefined modes of operation for monitoring distinct flame types and/or flame conditions, and a processor which selectively processes the output of the at least one flame detector unit for responses appropriate to the type and/or condition of the at least one flame.

2. A flame management system according to claim 1, wherein the processor selectively processes the output of the at least one flame detector unit and actively switches between said predefined modes of operation in response to changes in the condition of the at least one flame.

3. A flame management system according to claim 2, comprising at least one flame detector unit having a UV response mode and an IR response mode, said flame detector being selectively operable by the processor to provide either an IR or a UV response output thereto.

4. A flame management system according to claim 2, comprising at least one flame detector unit having a normal operating mode and a sensitive operating mode.

5. A flame management system according to claim 4, wherein said normal operating mode said at least one flame detector operates as one of a UV and an IR detector and in said sensitive operating mode said at least one flame detector operates as the other of a UV and an IR detector.

6. A flame management system according to claim 4, wherein said at least one flame detector which is operable in a normal and a sensitive mode is a dedicated IR or UV detector.

7. A flame management system according to any of claim 2, comprising at least one flame detector unit whose flicker frequency response and signal gain is variable by the processor to change its operating mode.

8. A flame management system according to claim 7, wherein at least one detector units has two pairs of settings for flicker frequency response and signal gain programmed into the processor, a first pair of status settings and a second pair of alternative settings.

9. A flame management system according to claim 8, wherein the status settings are suitable for monitoring a normal flame and the alternative settings are used to monitor transient combustion conditions.

10. A flame management system according to claim 7, wherein the signal gain is set to amplify the signal to lie substantially in the range of 0 to 10 volts.

11. A flame management system according to claim 1, wherein at least two detector units are used to monitor different regions of a single flame, the processor collating the output of each detector unit to derive information regarding both the presence and quality of the flame.

12. A flame management system according to claim 1, wherein the at least one detector unit monitors at least two different flames.

13. A flame management system according to claim 12, wherein the at least two flames occupy the same region at different times.

14. A flame detector unit having a first IR response mode and a second UV response mode and which is selectively operable to provide either an IR or a UV response output to a flame management processor, the detector unit comprising at least one photo-sensitive member upon which, in use, is incident at least one of an undivided IR component and an undivided UV component of light emitted by a monitored flame towards the detector, and a filter element which filters one of the IR component and the UV component of the light emitted by a flame, said filter being movable between a first position in which it is disposed in the optical ray path between the monitored flame and the photo-sensitive member, whereupon the photo-sensitive member is responsive to one of the IR and UV radiation emitted by the flame, and a second position in which the filter is retacted from the optical ray path, whereupon the photo-sensitive member is responsive to the other of the IR radiation component and the UV radiation component of the light emitted by the monitored flame.

15. A flame detector unit according to claim 14, wherein the filter is a UV pass filter which filters out the IR components of the light emitted by the flame, the photo-sensitive member being responsive to UV radiation when the filter is positioned to intersect the optical ray path.

16. A flame detector unit having a first IR response mode and a second UV response mode and which is selectively operable to pride either an IR or a UV response output to a flame management processor, the detector unit comprising; at least two photo-sensitive members upon each of which, in use, is incident one of an undivided IR component and an undivided UV component of light emitted by a monitored flame towards the detector; and an optical element disposed in the optical path of the flame to be viewed, wherein the optical element splits the radiation emitted by the monitored flame into an undivided IR component which is directed towards a first of said photo-sensitive members, and an undivided UV component which is directed towards a second of said photo-sensitive members.

17. A flame detector unit according to claim 16, wherein the optical element is a dichroic mirror which is disposed in the optical path between said flame and said first photo-sensitive member, light having a wavelength greater that a prescribed amount passing through said mirror and being incident on said first photo-sensitive member while light having a wavelength shorter than said prescribed amount is reflected towards said second photo-sensitive member.

18. A flame detector unit according to claim 16, wherein the optical element is a diffraction grating which diffracts the components of the radiation emitted by the flame according to their wavelengths and is arranged to direct an IR component towards said first photo-sensitive member and UV component towards said second photo-sensitive member.

19. A flame management system including at least two flame detector units arranged to monitor different regions of a single flame, wherein at least one of said flame detector units comprises a single photocell that has at least two predefined modes of operation for monitoring distinct flame types and/or flame conditions, and a processor that selectively processes the output of the at least two flame detector units for responses appropriate to the type and/or condition of the at least one flame.

* * * * *

UNITED STATES PATENT AND TRADEMARK OFFICE

CERTIFICATE OF CORRECTION

PATENT NO. : 6,329,921 B1
DATED : December 11, 2001
INVENTOR(S) : David Tindall et al.

It is certified that error appears in the above-identified patent and that said Letters Patent is hereby corrected as shown below:

Column 10, claim 14,
Line 63, "retacted" should read -- retracted --.

Column 11, claim 16,
Line 8, "pride" should read -- provide --.

Signed and Sealed this

Sixteenth Day of April, 2002

*Attest:*

*Attesting Officer*

JAMES E. ROGAN
*Director of the United States Patent and Trademark Office*